United States Patent [19]

Baines, deceased et al.

[11] Patent Number: 4,644,312

[45] Date of Patent: Feb. 17, 1987

[54] CIRCUIT BREAKER

[75] Inventors: Alfred H. P. Baines, deceased, late of Johannesburg, South Africa, by Dennis James Ridley, executor; Gianfranco Campetti; Walter A. Baumgartl, both of Kempton Park, South Africa; Klaus J. R. Nusse, Randburg, South Africa

[73] Assignee: Heinemann Electric (South Africa) Limited, Johannesburg, South Africa

[21] Appl. No.: 790,192

[22] Filed: Oct. 22, 1985

[30] Foreign Application Priority Data

Nov. 2, 1984 [ZA] South Africa ..... 84/8585

[51] Int. Cl.[4] ..... H01F 3/12; H01F 7/08

[52] U.S. Cl. ..... 335/236; 335/56; 335/62; 335/240

[58] Field of Search ..... 335/240, 242, 259, 260, 335/264, 265, 49, 56, 62, 236

[56] References Cited

U.S. PATENT DOCUMENTS

| | | | |
|---|---|---|---|
| 3,713,059 | 1/1973 | Tada | 335/259 |
| 3,900,810 | 8/1975 | Grenier | 335/62 |
| 4,276,526 | 6/1981 | Ciarcia et al. | 335/35 |

*Primary Examiner*—E. A. Goldberg
*Assistant Examiner*—Lincoln D. Donovan
*Attorney, Agent, or Firm*—Ladas & Parry

[57] ABSTRACT

A circuit breaker includes a tripping device in which a magnetic core is contained in a vessel of viscous fluid in a magnetic frame. An armature is disposed adjacent the core and is connected to a toggle mechanism. Under conditions of moderate overloads, the armature and the core ineract and the tripping device provides a time delay before it operates. Under severe fault conditions the armature is activated directly and the effect of the core is of less significance. The core or the armature are tapered, to provide a desired balance between the delayed and instantaneous operating characteristics.

11 Claims, 7 Drawing Figures

CIRCUIT BREAKER

BACKGROUND OF THE INVENTION

This invention relates to electrical circuit breakers.

Present circuit breakers generally fall into two categories: those employing a thermal element such as a bimetallic strip, and those employing electromagnetic devices. Certain existing circuit breakers employ a thermal element to trip the contact mechanism after a time delay under moderate overcurrent conditions, and an electromagnetic device to open the contacts under severe overcurrent conditions. The thermal element has, however, the particular disadvantage that its characteristics are affected by variations in ambient temperature, making its operation unpredictable to some degree.

The hydraulic magnetic circuit breaker provides an inverse time delay under moderate overcurrent conditions, that is, the delay in tripping the contact mechanism is inversely related to the magnitude of the overload. This type of circuit breaker is not unduly affected by variations in ambient temperature. At present, however, such circuit breakers cannot react very quickly to severe overcurrent conditions.

It is an object of the invention to provide a circuit breaker which includes the advantages of present hydraulic magnetic circuit breakers and which can react quickly to severe overcurrent conditions.

SUMMARY OF THE INVENTION

According to the invention, a circuit breaker includes a tripping device comprising a magnetic frame, a coil arranged to generate a flux in the magnetic frame when a load current exists in the coil; a movable magnetic core disposed within the magnetic frame, the core being movably contained in a vessel filled with a viscous fluid; and a magnetic armature disposed in proximity to the core and the frame and arranged to form a magnetic circuit with the core and the frame and to be influenced by flux passing between it and the core and the frame, the armature being arranged to be attached to a contact breaker mechanism, the armature and the core being arranged to be mutually attracted and to move toward each other under overload current conditions, the armature in addition being arranged to be urged strongly toward the core under severe overload current conditions by the flux passing between the armature and the frame.

The armature is preferably arranged concentrically with the core and arranged to travel along a common axis with the core so that the armature and the core can overlap when the armature and/or the core have moved sufficiently far in their respective directions of movement.

The core may be in the form of a generally cylindrical slug arranged to travel in a non-magnetic tube. The core may have a diameter less than the internal diameter of a bore provided in the armature into which the core can project.

Alternatively, the core may be in the form of a hollow section arranged to travel in a double walled non-magnetic tube. The armature may be receivable within the tube and the core may be arranged to fit over a portion of the armature when the armature projects into the tube.

In a preferred embodiment of the invention, the core is tapered at the end nearest the armature to increase the effective separation between the core and the armature during the period, in use, in which the core and the armature approach each other closely and begin to overlap, to thereby allow the required forces of attraction to be developed even after the core and the armature have overlapped.

Alternatively, the armature may be provided with a taper at the end nearest the core to increase the effective separation between the core and the armature during the period, in use, in which the core and the armature approach each other closely and begin to overlap, to thereby allow the required forces of attraction to be developed even after the core and the armature have overlapped.

BRIEF DESCRIPTION OF THE DRAWINGS

A circuit breaker according to the invention will now be described by way of example with reference to the accompanying drawings, in which.

DESCRIPTION OF A PREFERRED EMBODIMENT

Figure 1:
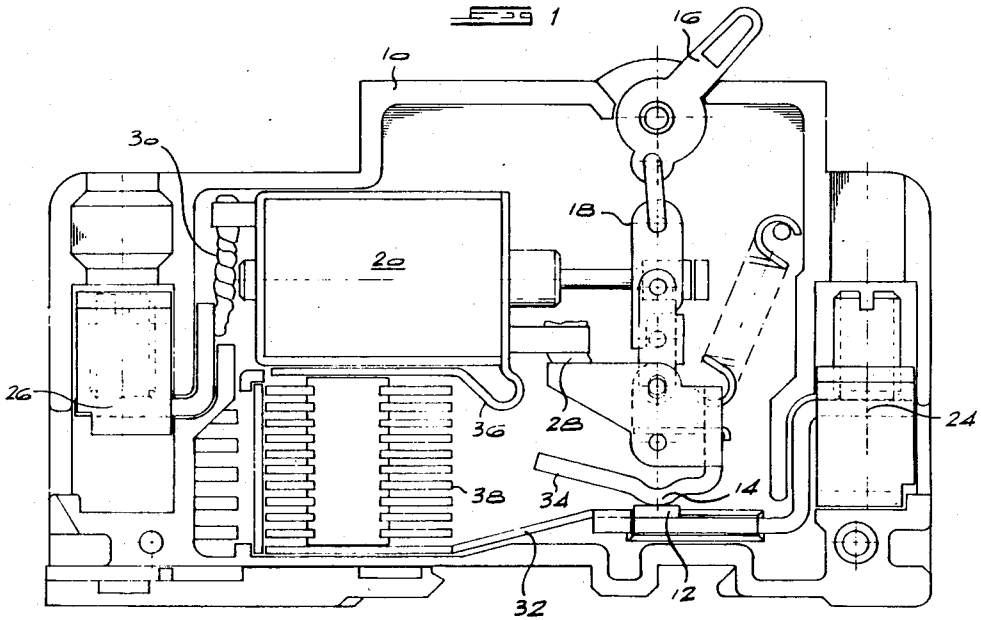
FIG. 1 is a side view of the interior of the circuit breaker.

Referring to FIG. 1 a circuit breaker comprises a housing 10, a pair of contacts 12 and 14, a switch handle 16 connected to a toggle-type mechanism 18, and a tripping device 20. The mechanism 18 is connected to the contact 14, which is movable relative to the contact 12. The tripping device 20 has an armature 22 which is also attached to the mechanism 18. Two terminals 24 and 26 are provided on the housing 10. A conductor connects the terminal 24 to the contact 12. A flexible conductor 28 connects the contact 14 to a coil in the tripping device 20, while another flexible conductor 30 connects the tripping device 20 to the terminal 26, so that when the contacts 12 and 14 are closed, there is an electrical path of low resistance betweeh the terminals 24 and 26. Adjacent the contacts 12 and 14 is an arc suppression device comprising runners 32, 34 and 36 which diverge from the contacts 12 and 14, and an arc extinguishing grid assembly 38. The runner 34 is formed as an extension of the contact 14.

Figure 2:
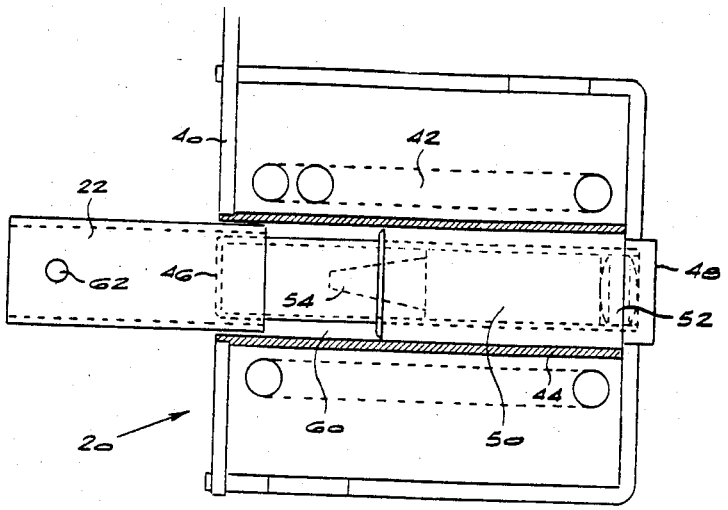
FIG. 2 is a cross-sectional view of one embodiment of a tripping device for use in the circuit breaker.
Figure 3:
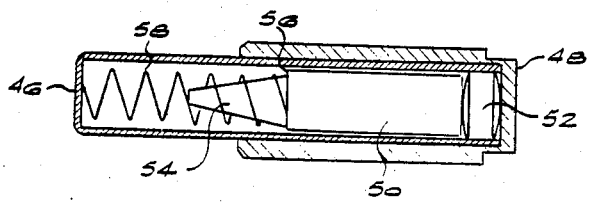
FIG. 3 shows a detail of FIG. 2.

Referring now to FIGS. 2 and 3, the tripping device 20 comprises a magnetic frame 40 in the centre of which is a coil 42 wound on a hollow cylindrical non-magnetic former 44. The frame 40 is made of soft iron, mild steel or another material possessing good magnetic properties. Inside the former 44 is a non-magnetic metal tube 46 which is closed at one end. The open end of the tube 46 is fitted into a hollow magnetic metal pole piece 48 and cemented or soft-soldered into position. Inside the tube 46, is a magnetic core 50 arranged to slide lengthways in the tube 46 in a viscous fluid. An optional plastics sealing plug 52 prevents leakage of the fluid prior to cementing or soldering the tube into position. The core 50 has a frusto-conical taper 54 at one end, and a shoulder 56 against which fits one end of a coil spring 58. The other end of the spring 58 bears against the closed end of the tube 46 and the spring 58 urges the core 50 against the sealing plug 52 at the open end of the tube 46. The pole piece 48 is fixed tightly to the frame 40, and forms part of the magnetic circuit within the frame 40. The pole piece 48 is shorter than the former 44.

A hollow cylindrical magnetic armature 22 is arranged to fit loosely over the tube 46 and within the former 44. The length of the armature 22 is sufficient for it to abut the polepiece 48 when fully inserted into the gap 60 between the former 44 and the tube 46. When fully inserted, the armature 22, together with the core 50 and the pole piece 48, completes a low-reluctance magnetic path within the frame 40. The armature 22 is provided at one end with a hole 62 and slots (not shown) to enable it to be attached to the toggle mechanism 18. The coil 42 is connected in series between the conductors 28 and 30 so that a load current flowing between the terminals 24 and 26 and passing though the coil 42 induces a flux in the frame 40.

In operation, when the load current in the coil 42 exceeds a predetermined value, typically 110% of the rating of the circuit breaker, the flux in the frame 40, and thus the force exerted on the core 50 due to the flux, becomes sufficiently great to cause the core 50 to overcome the force of the spring 58 and begin to move towards the closed end of the tube 46, thereby compressing the spring 58. The speed at which this movement can take place is limited by the viscous fluid, which must be displaced by the core 50 as it moves in the tube 46. As the core 50 approaches the Armature 22 that is fitted over the closed end of the tube 46, the concentration of flux in the armature 22 increases ahd thus the force on the armature 22, which tends to urge it towards the core 50, is also increased as the core 50 and the armature 22 are mutually attracted. The force is transmitted between the armature 22 and the frame 40 by virtue of the resistance of the spring 58 and the viscous fluid to the movement of the core 50, and via the fully compressed spring 58 when the core 50 reaches the end of its travel. Eventually this force becomes sufficent to overcome the mechanical resistance of the toggle mechanism 18 to which the armature 22 is connected, and the armature 22 is pulled in towards the polepiece 48, thereby actuating the mechanism 18 and opening the contacts 12 and 14. Depending on the magnitude of the overcurrent, the force exerted on the core 50 varies. The greater the overcurrent, the greater the force and the shorter the time delay before the core 50 approaches the armature 22 sufficiently closely to cause the armature 22 to pull in.

The flux leaving the pole piece 48 also exerts some force on the armature 22, but with small overloads this force is relatively small.

In the case of severe overcurrent conditions, the current in the coil 42 generates a powerful flux in the pole piece 48, which flux exerts a strong force on the armature 22, causing it to pull towards and to strike the pole piece 48. The force increases as the armature 22 pulls in, and is great enough to pull the armature 22 in before the core 50 has travelled any appreciable distance in the tube 46, so that severe overcurrent faults are responded to rapidly. The force on the armature 22 is due mainly to the flux passing between the pole piece 48 and the armature 22, and the core 50 plays a negligible or minor role under these conditions.

A common situation is that in which a severe overcurrent situation (such as a short-circuit) is preceded by a moderate overcurrent, as a fault develops. An example of such a situation is one in which the insulation on conductors is overheated by an overload, leading to failure of the insulation and a short-circuit. In such a case, the core 50 may have moved an appreciable distance along the tube 46 and its end may even have begun to overlap the end of the armature 22, without the armature 22 yet having pulled in. If a severe overcurrent fault now develops, the presence of the core 50 in close proximity to the armature 22 would tend to reduce the force acting on the armature 22 due to flux passing between the frame 40 and the armature 22. This is because the core 50 provides an alternative path for the flux. For this reason, the core 50 is designed to saturate when a strong flux exists in the frame 40, and the tapered end 54 of the core 50 increases the separation beween the core 50 and the armature 22 in this situation, so that the presence of the core 50 near the armature 22 does not adversely affect the flux pattern between the armature 22 and the frame 40. In this way, fast response to severe overcurrent faults is obtained even when preceded by a small or moderate overcurrent.

Figure 4:
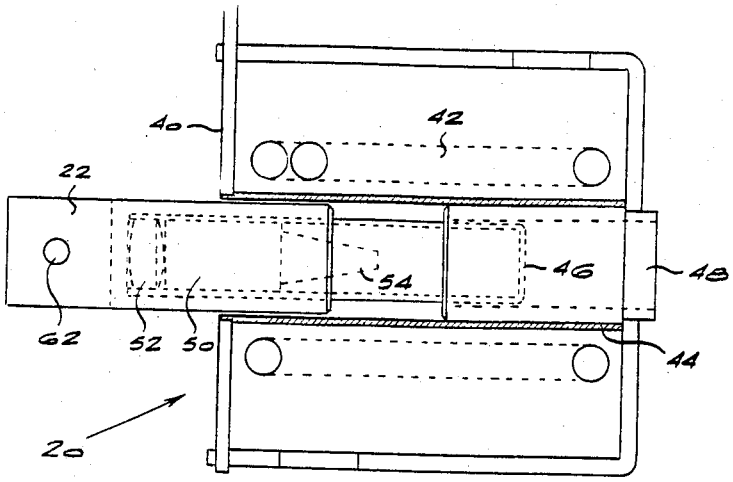
FIG. 4 is a cross-sectional view of a second embodiment of a tripping device for use in the circuit breaker.
Figure 5:
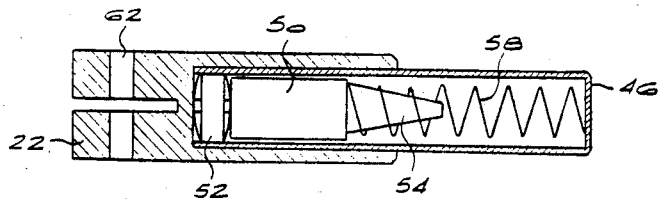
FIG. 5 shows a detail of FIG. 4.

An alternative tripping device 20 is illustrated in FIGS. 4 and 5. In ths device, the tube 46 is secured in the armature 22 rather than in the polepiece 48. The armature 22 is a loose fit inside the former 44 and the tube 46 is a loose fit inside the polepiece 48. In operation, moderate overcurrent causes the core 50 to begin moving against the spring 58 in the tube 46, due mainly to leakage flux passing between the core 50 and the frame 40. As the core 50 approaches the polepiece 48, the force on the core 50 is mainly due to flux passing between the core 50 and the polepiece 48, and the force increases. The force is transmitted to the armature 22, first indirectly via the resistance of the spring 50 and the viscous fluid in the tube 46, and then directly when the core 50 reaches the end of its travel in the tube 46. When the force is sufficient, the armature 22 pulls in. As with the above described tripping device 20, severe overcurrent faults cause the armature 22 to pull in rapidly, the taper 54 of the core 50 and the fact that the core 50 saturates under these conditions contributing to the rapid response.

Figure 6:
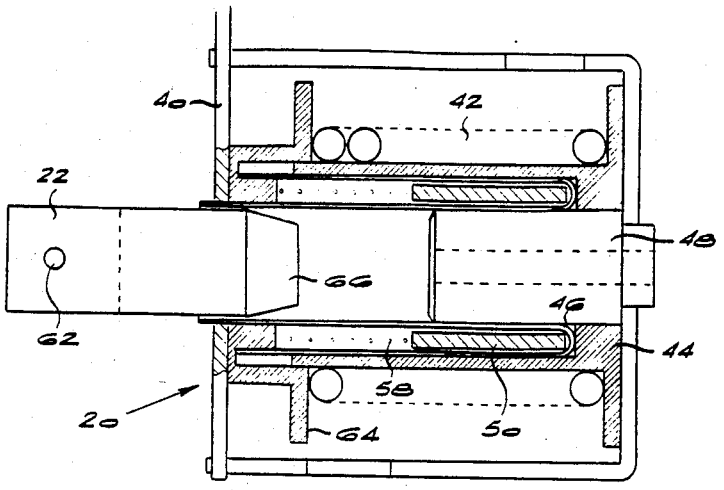
FIG. 6 is a cross-sectional view of a third embodiment of a tripping device for use in the circuit breaker.
Figure 7:
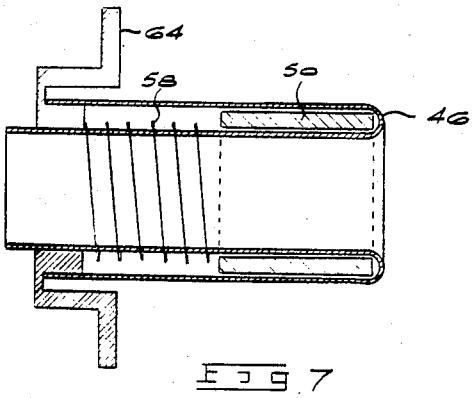
FIG. 7 shows a detail of FIG. 6.

A third version of the tripping device 20 is illustrated in FIGS. 6 and 7. In this version, the core 50 is a hollow cylindrical section arranged to move in a deep drawn nonmagnetic double-walled cylindrical tube 46 against a spring 58 and a viscous fluid. A non-magnetic end cap 64 seals the end of the tube 46 and acts in co-operation with the former 44 to hold the coil 42. The armature 22 is now a solid cylinder provided with a tapered end 66 and is a loose fit inside the tube 46.

Operation of this third version of the tripping device is very similar to that of the version illustrated in FIGS. 2 and 3. Moderate overcurrents cause the core 50 to move in the tube 46 against the spring 58 and the viscous fluid under the force caused by the leakage flux between the core 50 and the frame 40. As the core 50 approaches the armature 22, most of the flux passes between the core 50 and the armature 22, the force tending to increase as the core 50 approaches the armature 22, and eventually causing the armature 22 to pull in. Again, in the case of severe overcurrents, the armature 22 is pulled in strongly by the flux between it and the pole piece 48. A taper 66 is provided on the armature, rather than on the core 50, to maintain the pull-in force in the situation where a moderate overload is followed by a severe overload.

Generally, it has been found that by ensuring that the armature 22 is substantially outside the coil 42 at rest, an optimum ratio of forces on the armature 22 is a obtained for various fault circumstances.

In all versions of the tripping device 20, air gaps or passages are provided where necessary, for example in the polepiece 48 or the armature 22, to prevent air pressure build-up from affecting the operation of the device.

The armature 22 is connected in each case to the toggle mechanism 18 to which the moving contact 14 is connected. When the mechanism 18 is tripped under moderate overcurrent conditions, the contact 14 is moved away from the contact 12 mainly by the force of springs (not shown) in the mechanism 18. Under severe overcurrent conditions, the armature 22 is pulled in strongly and forces the toggle mechanism 18 to open faster than it would under spring force only. The design of the tripping device 20 allows the armature 22 to have a travel of 6 mm or more, so that the armature 22 can be connected to a directly acting toggle and physically pull it open under severe overload conditions. This enables the contacts 14 and 12 to open within 4ms or so of the severe fault occurring and to be pulled far enough apart so that, in conjunction with the arc extinguishing grid 38, arcing can be stopped before the overload current waveform reaches its first half-cycle peak.

We claim:

1. A circuit breaker including a tripping device comprising a magnetic frame, a coil arranged to generate a flux in the magnetic frame when a load current exists in the coil; a movable magnetic core disposed within the magnetic frame, the core being movably contained in a vessel filled with a viscous fluid; and a magnetic armature disposed in proximity to the core and the frame and arranged to form a magnetic circuit with the core and the frame and to be influenced by flux passing between the armature and the core and the frame, the armature being attached to a contact breaker mechanism, the armature and the core being arranged to be mutually attracted by flux passing substantially between the core and the armature when an over-current below a predetermined magnitude exists in the coil, so that the core initially moves towards the armature and the armature subsequently is pulled in towards the core as the separation between the core and the armature decreases, the armature additionally being arranged to be strongly pulled in towards the frame by flux passing substantailly between the armature and the frame when an overcurrent above the predetermined magnitude exists in the coil without a significant influence being exerted by the core.

2. A circuit breaker according to claim 1 in which the armature is arranged concentrically with the core, the armature and core being arranged to move towards one another along a common axis so that the armature and the core can overlap.

3. A circuit breaker according to claim 2 in which the core is in the form of a cylindrical slug arranged to travel in a non-magnetic tube.

4. A circuit breaker according to claim 3 in which the core has a diameter less than the internal diameter of a bore provided in the armature into which the core can project.

5. A circuit breaker according to claim 2 in which the core is in the form of a tubular section arranged to travel in a double-walled non-magnetic tube.

6. A circuit breaker according to claim 5 in which the armature can project into the tube so that the core surrounds at least a portion of the armature.

7. A circuit breaker according to claim 2 in which the core is tapered at the end nearest the armature to increase the effective separation between the core and the armature during the period, in use, in which the core and the armature approach each other closely and begin to overlap, to thereby allow the required forces of attraction to be developed even after the core and the armature have overlapped.

8. A cirucit breaker according to claim 2 in which the armature is provided with a taper at the end nearest the core to increase the effective separation between the core and the armature during the period, in use, in which the core and the armature approach each other closely and begin to overlap, to thereby allow the required forces of attraction to be developed even after the core and the armature have overlapped.

9. A circuit breaker according to claim 1 in which the core is saturable when the load current in the coil exceeds a predetermined value, corresponding to a severe overload current condition.

10. A circuit breaker according to claim 1 in which the core is disposed at least partially within the coil and the armature is disposed adjacent the coil prior to operation of the tripping device.

11. A circuit breaker according to claim 1 in which the contact breaker mechanism includes a toggle mechanism connected to the armature and arranged to open a pair of contacts on operation of the tripping device, the opening of the contacts being accelerated under severe overload current conditions by force exerted on the toggle mechanism by the armature.

* * * * *